US007137166B1

(12) United States Patent
Kraemer

(10) Patent No.: US 7,137,166 B1
(45) Date of Patent: Nov. 21, 2006

(54) TOOTHBRUSH

(75) Inventor: Hans Kraemer, Buehl-Altschweier (DE)

(73) Assignee: SmithKline Beecham GmbH & Co KG, Buehl (DE)

( * ) Notice: Subject to any disclaimer, the term of this patent is extended or adjusted under 35 U.S.C. 154(b) by 295 days.

(21) Appl. No.: 10/130,383

(22) PCT Filed: Nov. 14, 2000

(86) PCT No.: PCT/EP00/11373

§ 371 (c)(1),
(2), (4) Date: Sep. 10, 2002

(87) PCT Pub. No.: WO01/35792

PCT Pub. Date: May 25, 2001

(30) Foreign Application Priority Data

Nov. 17, 1999 (GB) ..... 9927037.3

(51) Int. Cl.
*A46B 9/04* (2006.01)
*A46B 5/00* (2006.01)

(52) U.S. Cl. ..... 15/167.1; 15/176.1; 15/145; 15/143.1

(58) Field of Classification Search ..... 15/167.1, 15/176.3, 144.1, 143.1, 176.6, 145, 176.1, 15/172; 403/20, 321, 329
See application file for complete search history.

(56) References Cited

U.S. PATENT DOCUMENTS

| | | | | |
|---|---|---|---|---|
| 3,894,807 | A * | 7/1975 | Betz, III | 403/221 |
| 5,253,948 | A | 10/1993 | Butler | 403/289 |
| 5,369,835 | A | 12/1994 | Clarke | 15/167.1 |
| 5,673,452 | A | 10/1997 | Chang et al. | |
| 5,875,510 | A * | 3/1999 | Lamond et al. | 15/167.1 |
| 6,029,307 | A * | 2/2000 | Baudoin | 15/145 |

FOREIGN PATENT DOCUMENTS

| | | |
|---|---|---|
| EP | 033641 A | 3/1989 |
| FR | A 2 624 766 | 12/1987 |
| GB | A 2 044 089 | 3/1979 |
| WO | WO91/17092 | 10/1992 |
| WO | WO92/17093 | 10/1992 |
| WO | WO 93/10688 A | 6/1993 |
| WO | WO 96/22038 A | 7/1996 |
| WO | WO97/07707 | 3/1997 |
| WO | WO 98/12947 | 4/1998 |
| WO | WO99/16332 | 4/1999 |

* cited by examiner

*Primary Examiner*—Gladys J P Corcoran
*Assistant Examiner*—S Balsis
(74) *Attorney, Agent, or Firm*—Nora Stein-Fernandez; Theodore A. Eurman

(57) ABSTRACT

A toothbrush with a replaceable head in which the handle has a socket and the head has a pin for insertion into the socket and the socket side walls or the pin comprise a resiliently deforable elastomer material differnt to the material of the socket side walls or pin. A preferred form of the toothbrush has its socket in a tubular structure resiliently supported between two fork-like arms.

19 Claims, 6 Drawing Sheets

Figure 1A:
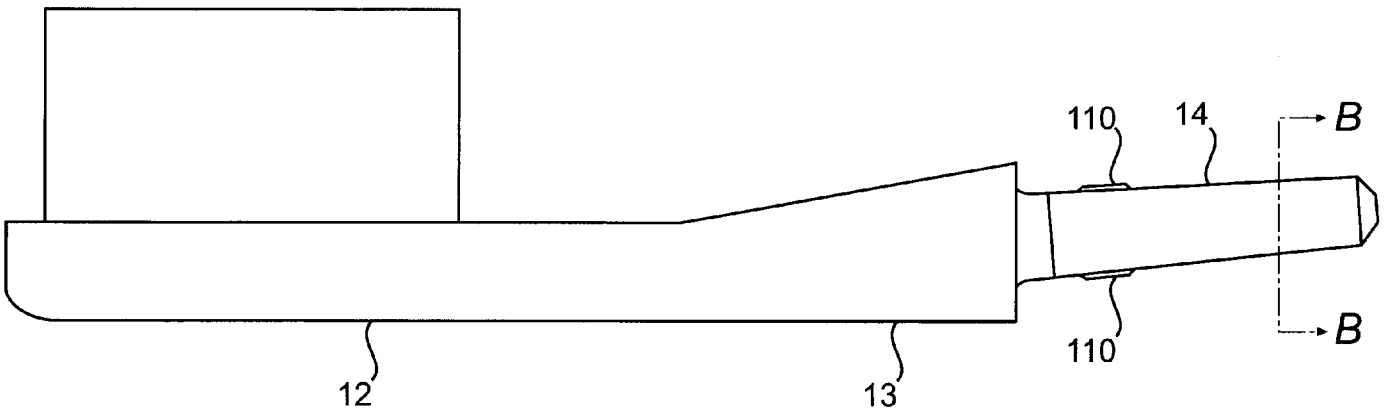

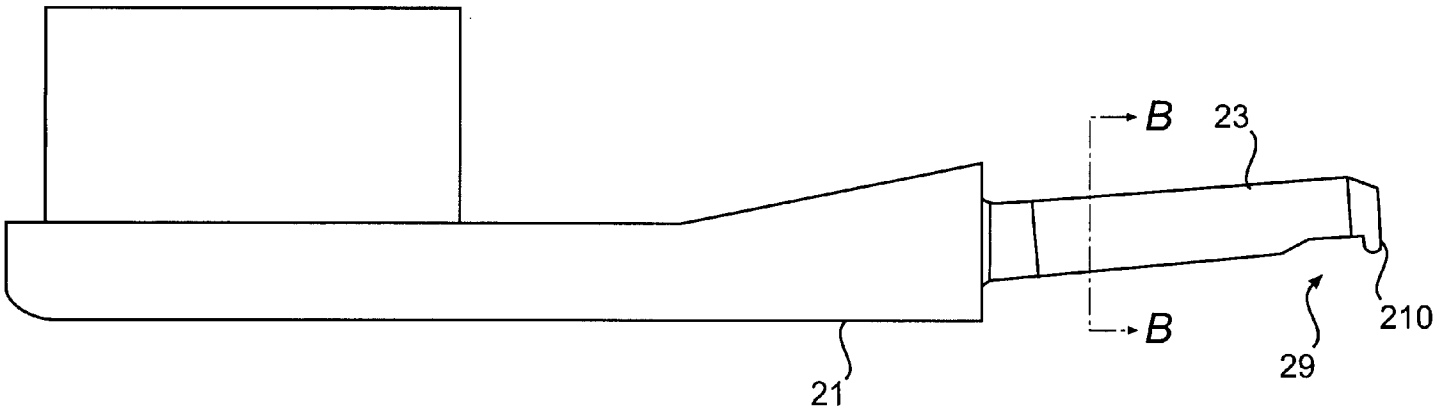
FIG. 2A
FIG. 2B
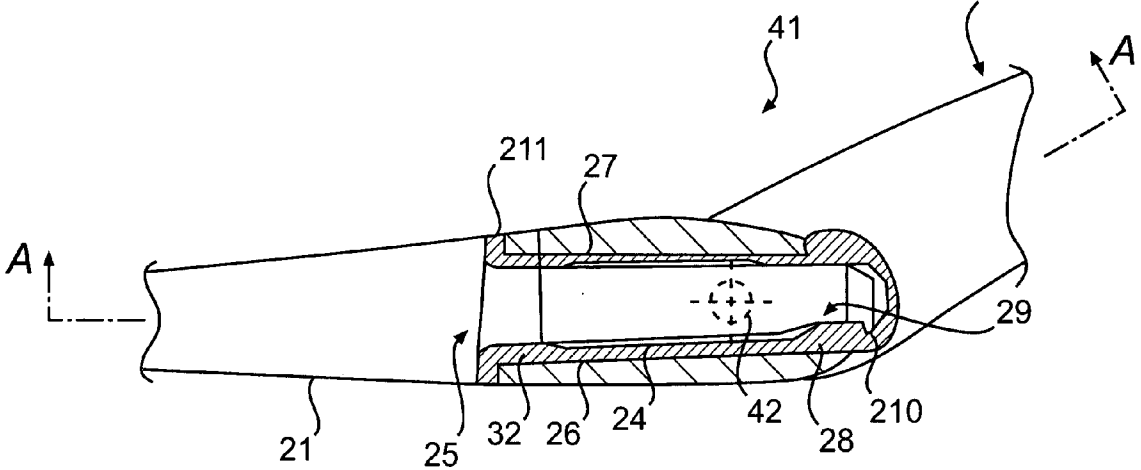
FIG. 2C

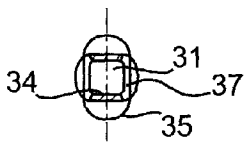
FIG. 3C
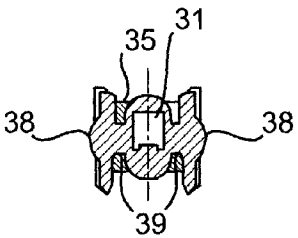
FIG. 3D
FIG. 3A
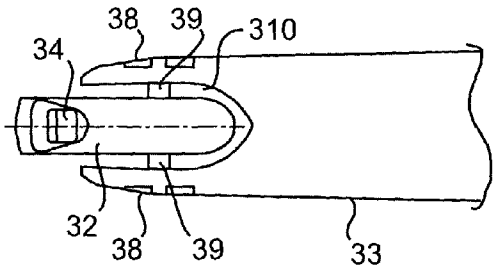
FIG. 3B
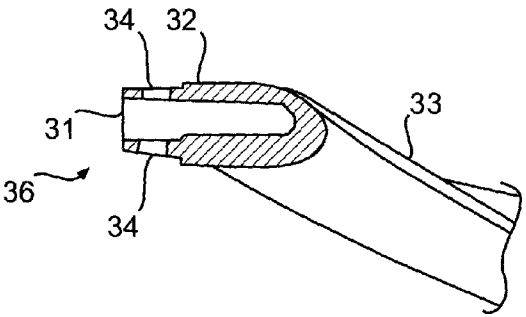
FIG. 3E
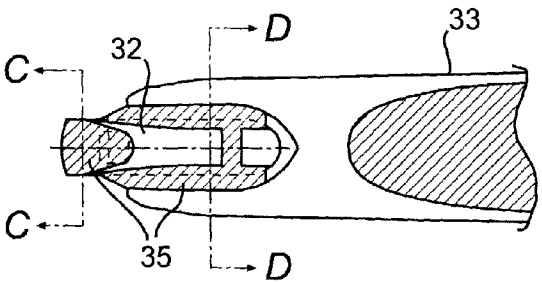

TOOTHBRUSH

FIELD OF THE INVENTION

This invention relates to toothbrushes, in particular to toothbrushes having a replaceable head.

BACKGROUND OF THE INVENTION

Toothbrushes are known having a replaceable head, so that the user retains the handle and simply fits a new head when the old head wears out or if the user prefers a different bristle type etc. This can save the user the expense of purchasing a whole new toothbrush, and can be environmentally more friendly in allowing a saving in the use of materials.

A problem with all replaceable head toothbrushes is that of ensuring that the head remains securely fixed to the toothbrush handle during use, whilst also using a cheap and simple connection means to link the head to the handle, and achieving this using the relatively cheap plastics materials which are commonly used for making toothbrushes. FR-A-2 624 766, U.S. Pat. No. 5,369,835, U.S. Pat. No. 5,253,948, GB-A-2 044 089 and WO 98/12947 suggest a variety of links between the handle of a toothbrush and a replaceable head part.

It is an object of this invention to provide a replaceable head toothbrush in which at least some of these problems are solved.

SUMMARY OF THE INVENTION

According to this invention a toothbrush is provided comprising a combination of a grip handle and a replaceable head which carries a dental cleaning tool, the handle and head being disposed along a longitudinal head-handle direction in which;

the grip handle is elongated and at an end thereof has a socket therein which has an opening facing in the direction of the head, and socket side walls extending away from the opening in a depth direction, the head has a pin oriented in the direction of the handle and which is insertable into the socket in the depth direction of the socket, the pin being releasably engageable with the socket, characterised in that at least part of the socket side walls and/or the pin comprise a resiliently deformable elastomer material different to the material of the socket side walls or pin.

DETAILED DESCRIPTION OF THE INVENTION

The term "elastomer" as used herein is used generally to include natural and synthetic materials having generally rubbery characteristics, that is, which have a natural resilience. Such materials are deformeable away from a rest position by the action of applied force, and on removal of this force spring back rapidly towards their rest position, ideally returning completely to their rest position. By the use of such an elastomer material in the toothbrush of the invention the resilience of the elastomer can be used in providing resilient parts of the pin and/or socket side walls, and so to cause part of the socket or pin to grip by resilience against an adjacent part of the pin or socket and thereby help to retain the pin in the socket. For example the resiliently deformable elastomer material may be deformed resiliently when the pin is inserted into the socket, so as to retain the head in engagement with the handle under the stresses experienced by the toothbrush during use in toothbrushing. Also many such elastomer materials have a relatively high coefficient of friction in contact with plastics materials, and this friction too may be used in the toothbrush of the invention to help to retain the pin in the socket by frictionally resisting relative movement of adjacent contacting parts of the pin and socket. Preferably there is a sufficient coefficient of friction between the elastomer and the part of the pin or socket which is in contact with the elastomer to help to retain the pin in the socket by friction.

In the toothbrush of the invention the dental cleaning tool may be a cluster of bristles, typically arranged in one or more tufts each containing a plurality of bristles. Alternatively the tool may comprise a dental flossing tool, for example including a length of dental floss. The term "toothbrush" as used herein includes all such types of dental cleaning tool. Such clusters of bristles and flossing tools are generally known in the toothbrush art.

The pin may be located on the head immediately adjacent to and extending from the base of the head, i.e. that end of the head which is closest to the handle.

In a preferred construction the head is extended integrally longitudinally from its base, to form an integral neck region between the base of the head and the handle, and the pin is located at the end of the neck nearest to the handle.

The pin and socket preferably generally conform to each other in size and shape. Various constructions of the pin and socket are included within the present invention.

Suitably the elastomer material comprises a part of the socket side wall.

For example the elastomer material may be situated in places on the pin and/or the socket side wall, e.g. as a layer or in patches covering part of the pin and/or the socket side wall, preferably the latter, so as to be resiliently compressed between the pin and the socket side wall when the pin is inserted into the socket. The compressed elastomer can thereby provide resilient and/or frictional grip between the pin and the socket side wall.

For example in a first, preferred, construction there is at least one cam surface on a side surface of the pin, the cam surface has a retaining shoulder at a side nearest the head, and the socket side wall has a resiliently deformeable part having a corresponding retaining shoulder which is biased outwardly from its rest position by the action of the cam surface when the pin is inserted into the socket and the pin is moved in the depth direction into the socket, then springs back toward its rest position behind the retaining shoulder of the pin when the retaining shoulder of the pin has passed the retaining shoulder of the socket, and the resiliently deformeable part of the socket side wall is made partly of plastic and partly of the elastomer material.

For example the cam surface may comprise a sideways displaced part of the pin, e.g. a projection from a side surface of the pin, e.g. having a wedge profile, or a step in a side surface of the pin. For example the resiliently deformeable part of the socket side wall may comprise a pair of jaw parts on opposite sides of the socket which are urged apart by contact with the cam surface and pressure from the cam surface as the pin is inserted into the socket, and then close behind the cam surface(s). The retaining shoulders may comprise surfaces which abut and which prevent the pin leaving the socket under the head-pulling stresses experienced by the head during toothbrushing, but which are profiled, e.g. with complementary wedge surfaces, so that the application by the user of a stronger head-pulling force to the head and consequently the pin can urge the jaw parts apart.

In this construction the construction of the resiliently deformeable part of the socket side wall partly of the plastic and partly of the elastomer material can be used to make a structure with suitable strength and resilience, e.g. it can have a relatively slight plastic skeleton, and can be bulked out to a suitable and aesthetic shape by means of the elastomer parts of the structure to form a resilient structure. In a preferred construction, within the socket deeper than the retaining shoulder of the socket there may be one or more cavity in the side wall, which receive(s) the cam part(s) of the pin when this/these pass the retaining shoulder(s) of the socket side walls, on insertion of the pin into the socket. Such cavity(ies) may contain an elastomer material which is resiliently deformed when a cam part of the pin is received therein. Such an elastomer material may consequently bear resiliently upon the cam surface(s) and thereby help to grip the pin. Additionally or alternately friction between the elastomer and the cam surface may help to frictionally resist unwanted movement of the pin out of the socket.

Two or more such cavities may be linked integrally by a mass of the elastomer, e.g. as deposited in a moulding channel for the elastomer to flow through on injection of the elastomer into an injection mould. Suitably the cavities in this construction are provided by apertures which pass completely through the socket side wall so that the elastomer may be introduced into the cavity through the side wall e.g. by a process of injection moulding.

Suitably in this first construction the retaining shoulder is located in the longitudinal half of the socket which is nearest to the opening of the socket, e.g. within 30% of the depth of the socket closest to the opening.

For example in a second construction, part of the socket side wall comprises the resilient deformable elastomer material, and the pin has at least one sideways displaced part, e.g. a projection sideways from a side surface of the pin, such that when the pin is inserted into the socket the at least one displaced part engages with the elastomer material by deforming the elastomer material when the pin is inserted into the socket.

Typically in this second construction the elastomer is deformed into a shape generally corresponding to a projection. In this construction the deformation of the elastomer is against its natural resilience, and the resilience of the elastomer in the socket consequently causes the elastomer to grip against the projection and thereby help to retain the pin in the socket. Preferably there is a sufficient coefficient of friction between the elastomer and the part of the pin which is in contact with the elastomer to help to retain the pin in the socket by friction.

In this second construction too preferably the elastomer material is disposed in one or more cavities in the side wall, for example one or more cavities bounded by the first hard plastics material. Two or more such cavities may be linked integrally by a mass of the elastomer, e.g. as deposited in a moulding channel for the elastomer to flow through on injection of the elastomer into an injection mould. Suitably the cavity(ies) in this construction is/are provided by one or more aperture which pass(es) completely through the socket side wall so that the elastomer may be introduced into the cavity through the side wall e.g. by a process of injection moulding.

Suitably in this second construction the part of the socket side wall which comprises the resilient deformable elastomer material, for example the cavities in which the elastomer is located, is in the longitudinal half of the socket which is nearest to the opening of the socket, e.g. within 30% of the depth of the socket closest to the opening.

In this second construction there are preferably two of the sideways projections on the pin and these are preferably regularly arranged around the perimeter of the pin, for example two projections 180° apart. The elastomer material may be disposed on the socket side wall in positions, e.g. in the said cavities, corresponding to the position(s) of the projection(s) on the pin when this is inserted in the socket.

Additionally, or alternately in a third construction, at least part of the socket side wall may comprise a resiliently deformable elastomer material which is in shape a convex bulge, i.e. perpendicularly to the longitudinal depth direction, into the socket in at least one place, so as to narrow the cross section of the socket relative to a deeper part of the socket, i.e. a part more longitudinally distanced from the head, and a side surface of the pin has at least one concavity distanced from the end of the pin furthest from the head, which, when the pin is inserted into the socket engages with the bulge of the elastomer material in the socket.

In this latter construction too the elastomer material may be disposed in one or more cavities in the socket side wall. Suitably again the cavities in this construction may be provided by apertures which pass completely through the socket side wall so that the elastomer may be introduced into the cavity through the side wall, and as above two or more such cavities may be linked integrally by a mass of the elastomer, e.g. as deposited in a moulding channel for the elastomer to flow through on injection of the elastomer into an injection mould. The elastomer material may be disposed on the socket side wall in one or more positions corresponding to the position(s) of the concavity(ies) on the pin when this is inserted in the socket. The profile of the bulge may substantially correspond with the profile of the concavity so that the bulge may fit neatly into the concavity.

For example the pin may engage with the elastomer material by the end of the pin remote from the head deforming the elastomer material out of its way against the resilience of the elastomer material as the pin is inserted into the socket, and then the concavity may engage with the bulge of the elastomer material by means of the elastomer material fitting into the concavity. For example the end of the pin on the side of the concavity remotest from the head may hook behind (i.e. deeper within the cavity) than the bulge of the elastomer.

There may be a single bulge of the elastomer material. Alternatively there may be more than one bulge of the elastomer material, for example two bulges disposed circumferentially 180° apart relative to the longitudinal axis around the socket side wall.

Suitably in this construction a bulge of the elastomer material is located in the longitudinal half of the socket which is furthest from the opening of the socket, e.g. within 30% of the depth of the socket furthest the opening.

Preferably in the toothbrush of the invention the socket tapers over at least part of its depth from a wider cross section nearer the opening to a narrower cross section deeper within the socket, and preferably the pin tapers correspondingly.

Suitably the socket and the pin are of generally corresponding cross sections across the longitudinal axis, preferably being of non-circular cross section to inhibit relative rotation of the head and handle about the longitudinal axis. Suitably this cross section may be oval in cross section or generally rectangular cross section (this term includes generally square) optionally with rounded corners or sides. The socket and pin may have one or more co-operating guide means, e.g. one or more longitudinally extending co-operating ridges and grooves in their adjacent surfaces to assist in aligning the pin within the socket and/or to prevent relative rotation of the head and handle about the longitudinal axis. For example the respective ends of the pin and the socket furthest from the head may be shaped, e.g. complementary, so that the pin can only fit in a single orientation in the socket. This too can help prevent accidental insertion of the pin in the socket in the wrong orientation.

The taper angle of the pin and socket may for example be 0.1–5°, for example 0.5±0.25°.

Suitably at the longitudinal end of the handle facing the head is a region of elastomer material which when the head is in place with the pin inserted into the socket abuts against the head, for example to form a soft buffer or cushion between the head and the handle. Also when the pin is inserted in the socket elastomer material in such a position can be resiliently compressed between the head and the handle and the resilience of the elastomer may apply pressure to the head to hold the head and handle in tension. For example this region of elastomer may be in the form of a ring or torus around the opening of the socket. Elastomer which is present in the above mentioned one or more cavities may be linked to such a region of elastomer by for example moulding channels in the plastics material of the socket side walls, or by the above mentioned covering of the elastomer over the tubular structure.

The head and handle are preferably made principally of hard plastic materials. The hard plastic materials of which the handle and head are respectively made may be the same plastics material but preferably the handle is made of a harder plastic material than the head. Typical hard plastic materials have a modulus of elasticity of at least ca. 500 Mpa, preferably at least ca 1000 Mpa, these being conventional in the art of toothbrush manufacture. For example the material of the handle may be a polyethylene terephthalate and the material of the head may be a polypropylene. A typical polypropylene is Polypropylene PM 1600 having a modulus of elasticity (ISO 178) of 1500 Mpa and Apryl 3400 MA1. The elastomer material may for example be a thermoplastic elastomer, e.g. having a Shore A hardness in the range 5–95, typically 30 Shore A to 80 Shore D. Typical elastomer materials are polyolefins, such as of the styrene-ethylene-butylene-styrene (SEBS) type. A typical thermoplastic elastomer is the known Kraton series of elastomers (a block copolymer of styrene and butadiene having a Shore A hardness in the range ca. 5–95). Another suitable thermoplastic elastomer is Santoprene or Thermoflex, e.g. Thermoflex 75', having a modulus of elasticity (ISO 178) of 100 Mpa and a Shore A hardness (ISO 868) of Shore A 80. Suitable plastics and elastomer materials are those which are commonly used in the manufacture of two-component, i.e. hard plastic and elastomer toothbrushes. Suitable conditions for moulding the toothbrush of the invention so that the plastic and elastomer materials bond are also known in the art of two-component toothbrush manufacture, and it is preferred that in the toothbrush of the present invention the plastic material and the elastomer material, particularly that present in the socket, are bonded together.

The toothbrush of the invention may include other known features of toothbrushes, e.g. elastomeric grip mats on the handle, and features to modify the flexibility of the toothbrush, e.g. of any one or more of the head, the handle, or of links between the head and neck. Examples of such flexibility modifying features are for example disclosed in for example EP 0 336 641A, WO 92/17092, WO 92/17093, WO 99/16332, WO 97/07707 among others.

In a preferred overall construction of the toothbrush of this invention the socket and its side walls comprise a tubular structure extending in the head-handle direction of the toothbrush, with the socket comprising the interior of the tube. For example one or more cavities for the elastomer, e.g. two cavities disposed on sides of the socket opposite each other across the longitudinal axis, may be provided in such a construction by providing one or more apertures passing through the wall of the tubular structure from its exterior to the interior, thereby enabling the elastomer to be introduced into the aperture(s) from the outside of the tubular structure via these apertures by an injection moulding process. For example the tubular structure may be at least partially covered by a covering of the elastomer e.g. to form an aesthetically shaped structure, so that the elastomer is exposed into the interior of the tubular structure, i.e. the socket, through the above-mentioned one or more aperture.

In a preferred construction the end of the handle nearest to the head is in the form of two arms extending toward the head, e.g. in a two armed fork like structure, the two arms being on either side of a plane which includes the longitudinal direction and the direction of the bristles, and the part of the handle including the socket, e.g. the above described tubular structure, is supported resiliently between these two arms, suitably by a resiliently flexible link to each arm, allowing the toothbrush to deform resiliently at this link when pressure is applied to the head during use. Such a construction can provide resilient flexible linking of the head to the handle via the links to the arms.

Suitably such a link may comprise an integral link between the handle, i.e. the arms, and the part of the handle which includes the socket, e.g. the tubular structure, which is able to deform torsionally when pressure is applied to the head. Such a link may comprise an integral torsion bar between such a tubular structure and each of the said arms. Such integral links may join the tubular structure near its longitudinal mid point, e.g. in the manner of a trunnion mounting. Suitably such a link may be enclosed within a covering of an elastomeric material which extends between the tubular structure and each of the arms and may be bonded thereto. Such an elastomeric material may deform resiliently when pressure is applied to the head during use. The deformation is suitably such that the relative angle between the neck and handle of the toothbrush changes from its rest, i.e. non-pressurised position, as pressure is applied to the head during use, and the angle reverts to the rest position angle when the pressure is released.

It is believed that such a toothbrush having the end of its grip handle nearest to the head in the form of two arms extending longitudinally toward the head, e.g. in a two armed fork like structure, the two arms being on either side of a plane which includes the longitudinal axis and the direction of the bristles, and a part of the handle, e.g. including a socket as described above, e.g. the above described tubular structure, being supported between these two arms by a resiliently flexible link to each arm, and having a head which is releasably engageable with the handle, e.g. by the above-described pin and socket, at the end nearest to the head of the part of the handle which is supported between these two arms is itself a novel construction, and is a further aspect of this invention.

The toothbrush of the invention may be a hand operated toothbrush, or its bristles may be driven by an electric motor.

The parts of the toothbrush of this invention, i.e. the plastic and elastomer parts of the head and the handle may be made by a process of injection moulding as conventional in the toothbrush art. In such a process the hard plastics material parts of the toothbrush may first be made in a first injection mould by injection of a plastics material in a fluid state. Then one or more of these plastic parts may be enclosed in a second injection mould and the elastomer material may be injected into this second mould to form the elastomer material parts of the toothbrush.

In further aspects the invention provides such an injection moulding process for making the toothbrush of the invention, and provides an injection mould suitable for use in this process.

The invention will now be described by way of example only with reference to the accompanying drawings FIGS. 1, 2, 3, 4 and 5 which show schematic part cutaway views of parts of toothbrushes of the invention, particularly illustrating the pin and socket, and the flexible link.

Figure 1B:
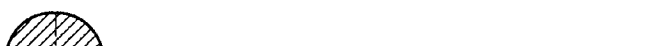
Figure 1C:
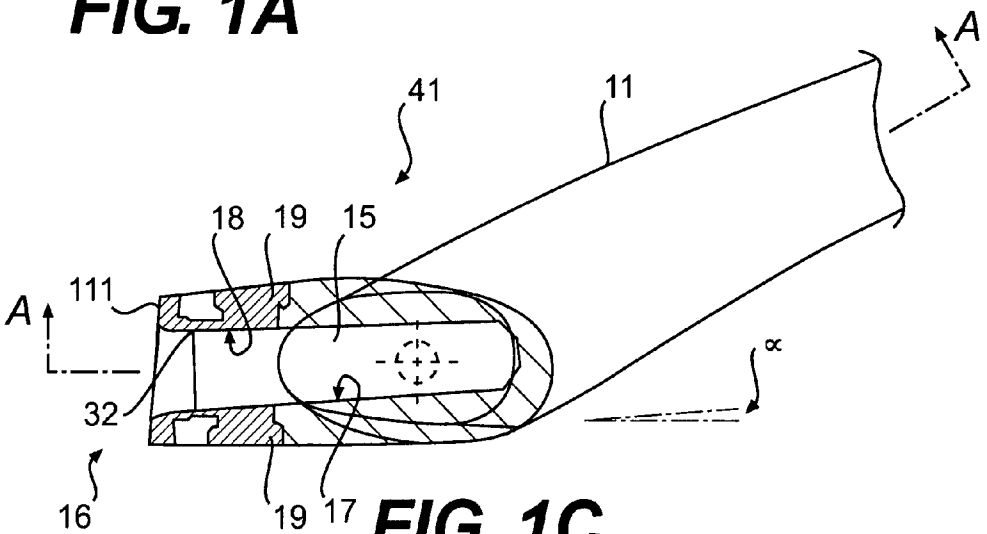
Figure 4A:
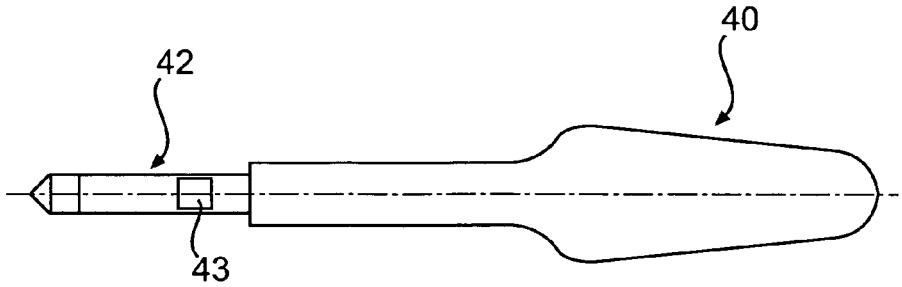
Figure 4B:
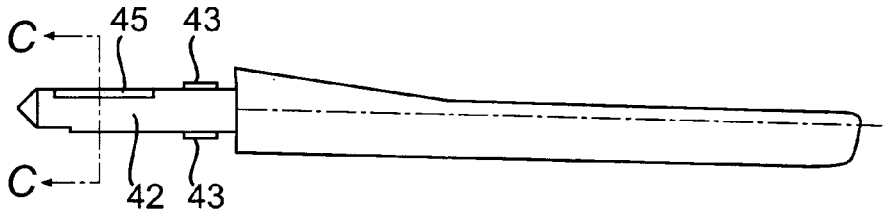
Figure 4C:
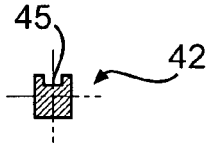
Figure 4D:
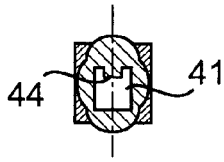

Referring to FIG. 1 a toothbrush is shown comprising a combination of a toothbrush handle 11 and a replaceable bristle-bearing head 12 disposed along a longitudinal head-handle axis A—A. FIG. 1A is a side view of the toothbrush head, FIG. 1B is a cross section through the pin of the head shown in FIG. 1A and FIG. 1C is a longitudinal sectional view of the part of the handle including the socket.

The head 12 is made of first hard plastic material, polypropylene, and is integrally longitudinally extended at its end closest to the handle 11 into a longitudinally extending neck 13 toward the handle 11. The neck 13 is integrally formed into a pin 14 located at the end of the neck 13 nearest to the handle 11.

The toothbrush handle 11 is made of a second hard plastic material, polyethylene terephthalate, and has a socket 15 therein which has an opening 16 facing in the direction of the head 12, and socket side walls 17 extending longitudinally away from the opening 16 in a depth direction. Part of the socket side walls 17 comprise a resiliently deformable elastomer material 18.

The elastomer material is located in two cavities 19 in the socket side wall 15. The profile of the side wall 17 together with the elastomer 18 material presents a continuous smooth surface internally. The regions of elastomer 19 are disposed in regions longitudinally bounded by the plastics material of the socket side wall 15.

The pin is insertable, and is shown inserted, in the depth direction into the socket 15 and in its shape and size generally conforms to the socket 15. The socket 15 and pin 14 taper over the length of the pin and the depth of the socket from a wider cross section nearer the opening 16 to a narrower cross section deeper within the socket 15. The alignment of the pin 14 is at an angle of ca. 5° to the general plane of the head 12 of the toothbrush, i.e. of the plane of the face of the head 12 from which the bristles project.

The pin 14 and socket have respective engagement features. These comprise the pin 14 having two projections 110 projecting generally sideways from its longitudinal sides. These projections 110 are disposed 180° apart, i.e. on opposite sides of the pin 14. When the pin 14 is inserted as shown into the socket 15 the projections 110 resiliently engage with the elastomer 18 material by deforming the elastomer material into a concave shape corresponding approximately to the shape of the projections 110. The elastomer material in the cavities resiliently grips the projections 110, and additionally friction between the elastomer and the projections 110 helps to retain the pin 14 in the socket 15. The pin 14 is thereby releasably engageable with the socket 15 but at the same time the head 12 is thereby retained in engagement with the handle 11 under the stresses experienced by the toothbrush during use in toothbrushing.

As shown in the cross section at B—B shown in FIG. 1B, the pin 14 and socket 15 both have generally conforming rectangular cross sections.

Referring to FIG. 2, a part of the neck 21 and the handle 22 of a toothbrush is shown, the remainder of the head and handle construction (not shown) being generally identical to FIGS. 1 and 2. FIG. 2A is a side view of the toothbrush head, FIG. 2B is a cross section through the pin of the head shown in FIG. 2A and FIG. 2C is a longitudinal sectional view of the part of the handle including the socket.

The head (not shown) is made of first hard plastic material, polypropylene, and is integrally extended as in FIG. 2 at its end closest to the handle 22 into the longitudinally extending neck 21 toward the handle 22. The neck 21 is integrally formed into a pin 23 located at the end of the neck 21 nearest to the handle 22.

The toothbrush handle 22 is again made of a second hard plastic material, polyethylene terephthalate, and has a socket 24 therein which has an opening 25 facing in the direction of the head and neck 21, and socket side walls 26 extending longitudinally away from the opening 25 in a depth direction. The socket side walls 26 are lined internally with a resiliently deformable elastomer material 27.

The elastomer material 27 bulges convexly into the socket 24 at a place 28 distance from the bottom of the socket so as to narrow the cross section of the socket 24 relative to part of the socket 24 deeper within the socket 24.

The side surface of the pin 23 has a concavity 29 which when the pin 23 is inserted into the socket 24 engages with the bulge 28 of the elastomer material 27 in the socket, so that a part 210 of the pin 23 deeper within the socket 24 hooks behind the bulge 28 of the elastomer material.

The socket 24 and pin 23 are of generally corresponding shapes, tapering longitudinally to narrow toward the longitudinally deepest part of the socket 24, and are of generally corresponding generally rectangular cross section, similar to that shown in FIG. 1B, thereby hindering relative rotation of the neck 21 and handle 22. The pin 23 is insertable, and is shown inserted, in the depth direction into the socket 24. The pin 23 is thereby releasably engageable with the socket 24 against the resilience of the elastomer bulge 28 but at the same time the neck 21 is thereby retained in engagement with the handle 22 under the stresses experienced by the toothbrush during use in toothbrushing.

In each of the constructions shown in FIGS. 1 and 2, at the longitudinal end of the handle facing the head is a region of elastomer material 111, 211 which when the head 12 is in place with the pin 14, 23 inserted into the socket 15, 24 abuts against the end of the neck which faces the handle to form a soft buffer or cushion between the head and the handle. This region 111, 211 of elastomer is in the form of a ring of elastomer material around the opening 16 of the socket. This region 111, 211 of elastomer material is integrally formed with the elastomer material 18, 27 in the same injection moulding operation and is consequently linked thereto by moulding sprue 112, 212. In each of FIGS. 1 and 2 the taper angle of the pin 14, 23 from the wider part nearer the head toward the narrower part nearer the handle is ca 2°.

FIG. 3 shows in more detail some preferred features of the toothbrush construction. FIG. 3A is a plan view, FIG. 3B is a part cutaway side view, FIG. 3C is a section at C—C, FIG. 3D is a section at D—D, FIG. 3E is a plan view showing the elastomer in more detail. In the toothbrush shown in FIG. 3 the socket 31 and its side walls are formed as a tubular structure 32 extending longitudinally from the handle (part shown) 33 of the toothbrush toward the head (not shown in FIG. 3), with the socket 31 comprising the interior of the tube. Two cavities 34 for the elastomer 35 are disposed on sides of the socket 31 opposite each other on the top and bottom faces of the tubular structure 32, i.e. across the longitudinal axis, being apertures passing through the wall of the tubular structure 32 from its exterior to the interior. This enables the elastomer to be introduced into the aperture(s) from the outside of the tubular structure 32 via these apertures. The arrangement of the apertures is shown more clearly in the cross section about line A—A shown in FIG. 3C. These apertures are located in the longitudinal half of the length of the socket 31 closest to the opening 36. The tubular structure 32 is at least partially covered by a covering of a mass of the elastomer 35 to form an aesthetically shaped structure as shown in FIG. 3E, so that the elastomer 35 is exposed into the interior of the socket 31. The elastomer 35 extends to the opening 36 of the socket 31 to form a buffer 37 around the opening 36.

FIG. 3 also shows in more detail a feature to modify the flexibility of the toothbrush. The end of the handle nearest to the head is in the form of two arms 38 extending longitudinally toward the head, being a two armed fork like structure, the two arms 38 being on either side of a plane which includes the longitudinal axis and the direction of the bristles (not shown in FIG. 3). The above described tubular structure 32 is supported between and linked to each of these two arms 38 by two resiliently flexible integral links 39 of the hard plastics material of the handle 33 and the tubular structure 32, each in the form of a cylindrical torsion bar, which is able to deform torsionally when pressure is applied to the head. This leaves a gap 310 between the tubular structure 32 and each arm 38. The link is enclosed within a covering of the elastomer material 35 which extends between the tubular structure 32, occupying the gap 310, and each of the arms 38 and is bonded thereto. The arrangement of the cylindrical structure 32, the arms 38, the link 39 and the gap 310 is more clearly shown in the cross section about line D—D shown in FIG. 3D. The elastomer material 35 deforms resiliently when pressure is applied to the head during use. The deformation is such that the relative angle between the neck (not shown in FIG. 3) and the handle 33 of the toothbrush changes from the corresponding angle in a rest, i.e. non-pressurised position, as pressure is applied to the head during use, and the angle reverts to the rest position angle when the pressure is released.

FIG. 4 shows some details of preferred features of the socket 41 and pin 42. FIG. 4A is a plan view of the head 40 of the toothbrush, FIG. 4B a side view, FIG. 4C a section through the pin at C—C, and 4D a section through the part of the socket at the plane of section C—C when the pin 42 is inserted into the socket 41. In FIG. 4 the pin 42 has two projections 43 which are slightly raised, e.g. ca. 0.2 mm on a pin with an overall cross section of ca 3–4 mm, areas of the plastics material of the pin, regularly arranged around the perimeter of the pin, 180° apart, the elastomer material in the socket 31 of FIG. 3 is disposed on the socket side wall, i.e. in the cavities 34 of FIG. 3 in positions corresponding to the position(s) of the projection(s) on the pin 42 when this is inserted in the socket 41. The socket 41 and pin 42 have co-operating guide means being a longitudinally extending co-operating ridge 44 in the socket 41 and a groove 45 in the adjacent surface of the pin 42, being on the side of the pin 42 in which the bristles face, which cooperage to assist in aligning the pin 42 within the socket 41 and to prevent relative rotation of the head and handle about the longitudinal axis.

FIG. 5 shows in detail a further construction of the socket 51. FIG. 5A shows a plan view of part of the toothbrush handle in the region of the tubular structure. FIG. 5B shows a cross section through the tubular structure of FIG. 5A at line B—B, FIG. 5C shows a cross section through the tubular structure of FIG. 5A at line C—C. FIG. 5D shows a longitudinal section through the tubular structure of FIG. 5A, cut perpendicular to the plane of FIG. 5A. FIG. 5E shows a side view of the head of the toothbrush of FIG. 5.

The socket 51 is formed in a tubular structure 52, which is mounted between and integrally linked by two torsion bars 53 on opposite sides of the tubular structure 52 to two fork arms 54 in a construction analogous to that of FIG. 4. The pin 55 is of generally similar tapering shape to that shown in FIG. 4. and there are two integrally formed cam surfaces 56 on opposite side surfaces of the pin 55, being sideways integral projections from opposite side surfaces of pin 55. Each cam surface 56 has a retaining shoulder 57, being the surface of the cam surface 56 closest to the head 58 of the toothbrush. The socket 51 corresponds closely to the shape of the pin 55.

The tubular structure 52 is made of the hard plastic material of the toothbrush handle, and has two apertures 59 passing respectively through opposite sides of the tubular structure 52. In the region of the apertures 59 the plastic material of the tubular structure 52 is thin enough that the end of the tubular structure 52 adjacent to the open end of the aperture is resiliently deformeable. The part 510 of the tubular structure 52 immediately adjacent to the open end of the socket 51, i.e. between the aperture 59 and the open end, can consequently be biased outwardly (i.e. in the direction of the arrow in FIG. 5D) under the action of force. The surface 511 of part 510 is a retaining shoulder. The tubular structure 52 is partly covered with a layer of an elastomer material 512, which is formed into an aesthetic shape between the arms 54 and the tubular structure 52, occupies the apertures 59, and also extends around the rim surface 513 of the open end of the socket 51.

When in use the pin 55 is inserted into the socket 51, the cam surfaces 56 firstly contact the parts 510 of the tubular structure 52. The end 514 of each cam surface 56 has a wedge profile, and further movement of the pin 55 into the socket 51 in the depth direction (right to left in FIG. 5) causes the parts 510 to be biased outwardly from their rest position in the direction shown by the arrows in FIG. 5D. This may cause a consequent inward deformation of the sides of the tubular structure 52 in the direction of the arrows in FIG. 5C, but the tubular structure 52 is thin enough to accommodate this. When the retaining shoulder 57 of the pin has passed the retaining shoulder 511 of the socket, the parts 510 then spring back toward its rest position i.e. in the opposite direction to the arrows shown in FIG. 5B. The parts 510 thereby function as jaw parts, opening to receive the pin 55 and then closing to grip and retain it. The respective retaining shoulders 57, 511 then abut and prevent the pin 55 from leaving the socket 51 under the stresses experienced by the toothbrush head 58 during toothbrushing, but the profile of the shoulders 57, 511 is such that the application of a pulling force to the head 58 and consequently the pin 55 can urge the parts 510 apart. For example the shoulder 57 may also be wedge-shaped, but more steeply than the cam surfaces 56 so that greater force is required to remove pin 55 from socket 51 than is required to initially insert it into the socket 51. When the cam parts 56 are behind the parts 510, i.e. deeper within the socket 51, the cam parts 56 are received in the apertures 59, and the elastomer material 512 therein is deformed and grips the cam parts 56 by virtue of its natural resilience. This is shown in FIG. 5F. The elastomer material 512 has a high coefficient of friction relative to the plastic material of the cam parts 56 and this friction also helps to retain the pin 55 in the socket 51. The elastomer 512 around the rim surface 513 is compressed between the surface 513 and the end surface 515 of the neck 516 when the pin 55 is fully in place in the socket 51, and this compression applies resilient pressure to the shoulders 57, 59 to hold the pin in tension.

The construction of the tubular structure 52 partly of the plastic and partly of the elastomer material 512 enables the tubular structure to have suitable strength and resilience, e.g. it has a relatively slight plastic skeleton, and is bulked out to an aesthetic shape by means of the elastomer material 512.

Figure 5A:
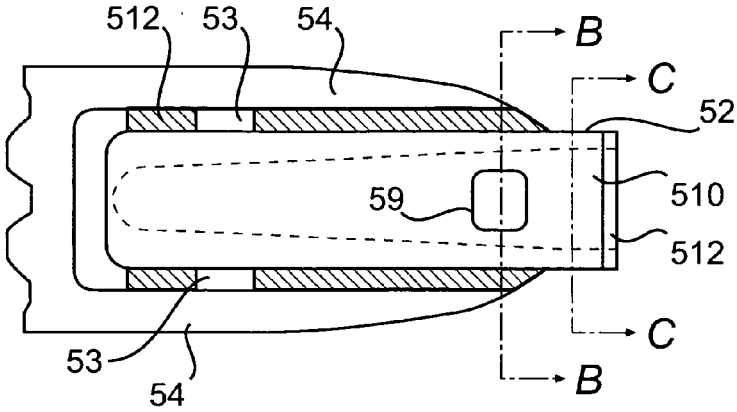
Figure 5B:
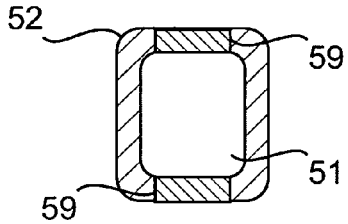
Figure 5C:
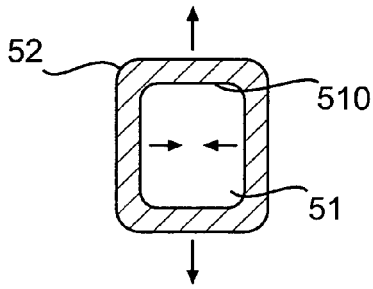
Figure 5D:
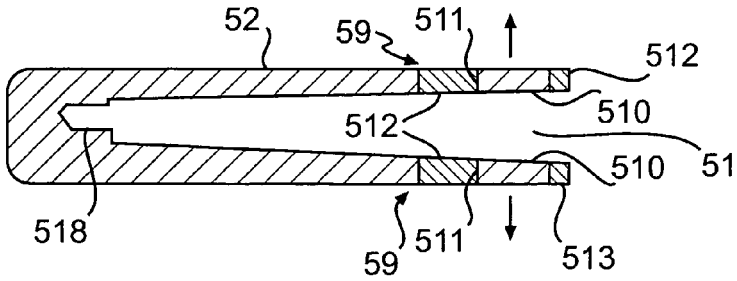
Figure 5E:
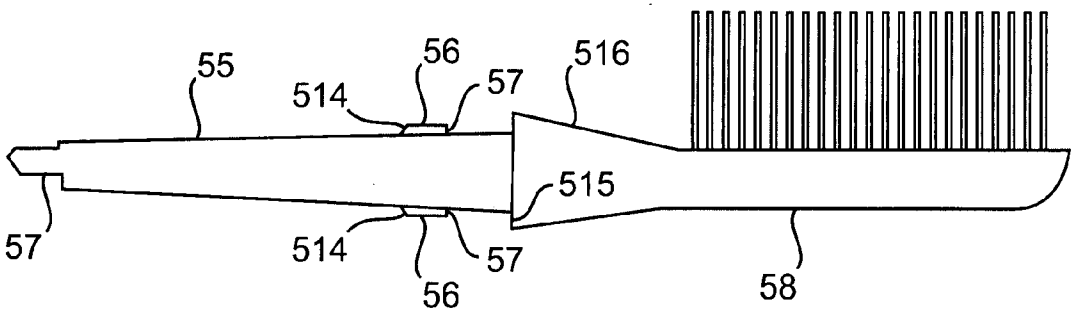
Figure 5F:
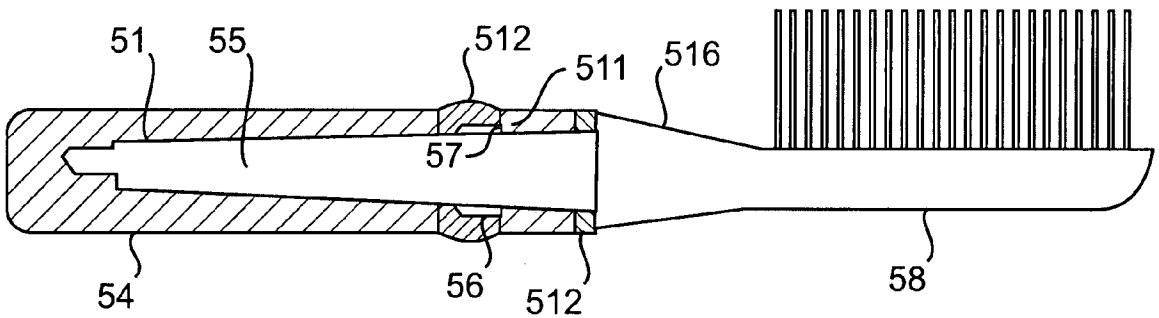

It is seen in FIGS. 5D and 5E that the end of the pin 55 remote from the head 58 and the deepest part of the socket 51 are shaped with respective steps 517, 518 so that the pin 55 will fit into socket 51 in only one orientation.

The invention claimed is:

1. A toothbrush comprising a combination of a grip handle and a replaceable head which carries bristles extending in a direction, the handle and head being disposed along a longitudinal head-handle direction in which;

the grip handle is elongated and at an end thereof has a socket therein which has an opening facing in the direction of the head, and socket side walls extending away from the opening in a depth direction, the socket and its side walls comprising a tubular structure with the socket comprising the interior of the tubular structure, the end of the handle nearest to the head being in the form of two arms extending toward the head, the two arms being on either side of a plane which includes the longitudinal direction and the direction of the bristles, the tubular structure being supported resiliently between these two arms, the head has a pin oriented in the direction of the handle and which is insertable into the socket in the depth direction of the socket, the pin being releasably engageable with the socket, characterised in that at least part of the socket side walls comprise a resiliently deformable elastomer material different to the material of the pin, and the resiliently deformable elastomer material is deformed resiliently by the action of inserting the pin into the socket, so as to retain the head in engagement with the handle under the stresses experienced by the toothbrush during use in toothbrushing.

2. A toothbrush according to claim 1 characterised by a sufficient coefficient of friction between the elastomer and the part of the pin or socket which is in contact with the elastomer to help to retain the pin in the socket by friction.

3. A toothbrush according to claim 1 characterised in that the head is extended longitudinally from its base to form an integral neck region between the base of the head and the handle, and the pin is located at the end of the neck nearest to the handle.

4. A toothbrush according to claim 1, characterised in that the elastomer material is situated in places on the socket side wall so as to be resiliently compressed between the pin and the socket side wall when the pin is inserted into the socket and thereby provides resilient and/or frictional grip between the pin and the socket side wall.

5. A toothbrush according to claim 1 characterised in that there is at least one cam surface on a side surface of the pin, the cam surface has a retaining shoulder at a surface thereof nearest the head, and the socket side wall has a resiliently deformeable part having a corresponding retaining shoulder which is biased outwardly from its rest position by the action of the cam surface when the pin is inserted into the socket and the pin is moved in the depth direction into the socket, then springs back toward its rest position behind the retaining shoulder of the pin when the retaining shoulder of the pin has passed the retaining shoulder of the socket, and the resiliently deformeable part of the socket side wall is made partly of plastic and partly of the elastomer material.

6. A toothbrush according to claim 5 characterised in that the cam surface comprises a projection from a side surface of the pin and the resiliently deformeable part of the socket side wall comprises a pair of jaw parts on opposite sides of the socket which are urged apart by contact with the cam surface and pressure from the cam surface as the pin is inserted into the socket, and then close behind the cam surface(s).

7. A toothbrush according to claim 5 characterised in that within the socket deeper than the retaining shoulder of the socket there is one or more cavity in the side wall, which receive(s) the cam part(s) of the pin when this/these pass the retaining shoulder(s) of the socket side walls on insertion of the pin into the socket.

8. A toothbrush according to claim 7 characterised in that such cavity(ies) contain an elastomer material which is resiliently deformed when a cam part of the pin is received therein.

9. A toothbrush according to claim 5 characterised in that the retaining shoulder is located in the longitudinal half of the socket which is nearest to the opening of the socket.

10. A toothbrush according to any claim 1 characterised in that part of the socket side wall comprises the resilient deformable elastomer material, and the pin has at least one sideways displaced part such that when the pin is inserted into the socket the at least one displaced part engages with the elastomer material by deforming the elastomer material when the pin is inserted into the socket.

11. A toothbrush according to claim 10 characterised in that the pin has side surfaces and the sideways displaced part is a projection sideways from a side surface of the pin and the elastomer is deformed against its natural resilience, and the resilience of the elastomer in the socket consequently causes the elastomer to grip against the projection and thereby help to retain the pin in the socket.

12. A toothbrush according to claim 10 characterised in that the elastomer material is disposed in one or more cavity in the side wall.

13. A toothbrush according to claim 1 characterised in that at least part of the socket side wall comprises a resiliently deformable elastomer material which bulges into the socket, so as to narrow the cross section of the socket relative to a deeper part of the socket, and a side surface of the pin has at least one concavity distanced from the end of the pin furthest from the head, which, when the pin is inserted into the socket engages with the bulge of the elastomer material in the socket.

14. A toothbrush according to claim 13 characterised in that the end of the pin on the side of the concavity remotest from the head hooks behind the bulge of the elastomer.

15. A toothbrush according to claim 1 characterised in that the socket tapers over at least part of its depth from a wider cross section nearer the opening to a narrower cross section deeper within the socket, and the pin tapers correspondingly.

16. A toothbrush according to claim 1 characterised in that the socket and the pin are of generally corresponding non-circular cross section.

17. A toothbrush according to claim 1 characterised in that at the longitudinal end of the handle nearest the head is a region of elastomer material which when the head is in place with the pin inserted into the socket abuts against the head.

18. A toothbrush according to claim 1 characterised in that the head and handle are made principally of hard plastic materials, the handle being made of a harder plastic material than the head.

19. A toothbrush according to claim 1 characterised in that the tubular structure is supported by a flexible link provided between each arm and the tubular structure, comprising an integral link which is able to deform torsionally when pressure is applied to the head.

* * * * *